US007016832B2

(12) United States Patent
Choi

(10) Patent No.: US 7,016,832 B2
(45) Date of Patent: Mar. 21, 2006

(54) VOICED/UNVOICED INFORMATION ESTIMATION SYSTEM AND METHOD THEREFOR

(75) Inventor: Yong Soo Choi, Kyonggi-do (KR)

(73) Assignee: LG Electronics, Inc., Seoul (KR)

( * ) Notice: Subject to any disclaimer, the term of this patent is extended or adjusted under 35 U.S.C. 154(b) by 791 days.

(21) Appl. No.: 09/898,624

(22) Filed: Jul. 3, 2001

(65) Prior Publication Data

US 2002/0062209 A1 May 23, 2002

(30) Foreign Application Priority Data

Nov. 22, 2000 (KR) ..... 2000-69454

(51) Int. Cl.
*G10L 11/06* (2006.01)

(52) U.S. Cl. ..... 704/208; 704/207; 704/214; 704/219; 704/206; 704/223

(58) Field of Classification Search ..... 704/206–208, 704/214, 219, 223, 108
See application file for complete search history.

(56) References Cited

U.S. PATENT DOCUMENTS 5,216,747 A * 6/1993 Hardwick et al. ..... 704/208
5,226,108 A * 7/1993 Hardwick et al. ..... 704/200
5,581,656 A * 12/1996 Hardwick et al. ..... 704/258
5,809,455 A * 9/1998 Nishiguchi et al. ..... 704/214
5,890,108 A * 3/1999 Yeldener ..... 704/208
6,067,511 A * 5/2000 Grabb et al. ..... 704/223

* cited by examiner

*Primary Examiner*—Vijay Chawan
(74) *Attorney, Agent, or Firm*—Lee, Hong, Degerman, Kang and Schmadeka

(57) ABSTRACT

A voiced/unvoiced information estimation system uses input spectrum and synthetic spectrum to produce a voicing level spectrum. The estimation system uses a spectrum difference calculation unit to normalize a spectrum difference energy for each harmonic band in unit of harmonic band, and further uses a voicing level calculation unit to calculate a voicing level. The voicing level of each harmonic band has a continuous value between 1 and 0. The estimation system is effective in vector quantization of voiced/unvoiced information at a low bit rate. Because it is unnecessary to calculate a threshold for deciding a voiced/unvoiced information, a decision anomaly occurring due to threshold is eliminated, and the accuracy of a voicing level is improved. Furthermore, since a spectrum is represented by mixing a voiced element and a unvoiced element in a harmonic band, the estimation system improves the audio quality of a combined sound.

20 Claims, 5 Drawing Sheets

VOICED/UNVOICED INFORMATION ESTIMATION SYSTEM AND METHOD THEREFOR

CROSS REFERENCE TO RELATED ART

This application claims the benefit of Korean Patent Application No. 2000-69454, filed on Nov. 22, 2000, which is hereby incorporated by reference in its entirety.

BACKGROUND OF THE INVENTION

1. Field of the Invention

The present invention relates to an estimation system and method, and more particularly, to a voiced/unvoiced information estimation system used in a vocoder which improves the audio quality of a voiced/unvoiced mixed sound and is appropriate for the vector quantization at a low bit rate.

2. Discussion of the Related Art

Generally, vocoders compress the frequency distribution, strength and waveform of corresponding voice data into codes, transmitting them upon receipt of a human voice through a microphone while decompressing voices at its receiving side. They are being utilized in many fields such as mobile communication terminals, exchangers, and video conference systems. Low bit rate vocoders necessary to multimedia communication and voice storage systems such as NGN-IP(Next Generation Network—Intelligent Peripheral) or VOIP (Voice over Internet Protocol) are mostly CELP (Code-Exited Linear Prediction) vocoders.

Most of vocoders having a bit rate of 4 to 13 Kbps are CELP vocoders which are time domain vocoders. Most of vocoders having a bit rate of less than 4 Kbps are frequency domain vocoders (also known as a harmonic vocoder). The harmonic vocoder represents an excitation signal as a linear combination of harmonics of a fundamental frequency. Accordingly, the audio quality of the combined sound of the harmonic vocoder is less natural for unvoiced signals compared with the CELP vocoder representing an excitation signal in the form of white noise. However, for voiced signals to which most speech signals correspond, the harmonic vocoder can produce good quality sounds at a bit rate much lower than that of the CELP vocoder.

Those vocoders having a very low bit rate of less than 4 Kbps (which will be an important matter of concern later) are mostly harmonic speech coders requiring harmonic analysis. Generally, the harmonic speech coder is composed of a harmonic analyzer and a harmonic synthesizer. In the harmonic analyzer, the part affecting the complexity and audio quality of the harmonic coder is a voiced/unvoiced information estimation module which estimates the voicing level at a frequency band. The harmonic analyzer analyzes harmonic parameters, and calculates voicing levels to quantize and transmit them. The harmonic synthesizer mixes a voiced element and an unvoiced element according to the quantized voicing level and harmonic parameters transmitted from the harmonic encoder.

In the conventional voiced/unvoiced estimation method, three harmonic bands are combined and are set as one voicing level decision band. As illustrated in FIG. 1, the voiced/unvoiced information estimation unit adapting this method includes a spectrum difference calculation unit 10, a threshold calculation unit 20, and a voiced/unvoiced information binary decision unit 30.

Here, the spectrum difference calculation unit 10 performs a normalization process for dividing the difference energy between an input spectrum and a synthetic spectrum by spectrum energy in the current voicing level determination band. The threshold calculation unit 20 calculates the threshold for deciding a voicing level using spectrum energy distribution, a basic frequency, and voiced/unvoiced information in the previous frame. The voiced/unvoiced information binary decision unit 30 performs a binary decision for the voicing level in the current voicing level decision band by comparing the normalized spectrum difference energy with the threshold.

Therefore, if the spectrum difference energy in the current voicing level decision band is higher than the threshold, the value of the voicing level in the current voicing level decision band is determined to be 0, which means an unvoiced band. Conversely, if the spectrum difference energy in the current voicing level decision band is lower than the threshold, the value of the voicing level in the current voicing level decision band is determined to be 1, which means a voiced band. Currently, the three harmonic bands are combined and set as one voicing level decision band to decrease the encoding bit rate, and the maximum number of voiced degree decision bands is limited to 12.

The encoder transmits the obtained binary voiced/unvoiced decision information. The decoder synthesizes the unvoiced signal using the binary voiced/unvoiced decision information transmitted from the encoder, if the value of the binary voiced/unvoiced decision information is 0 in each harmonic band. Alternatively, it synthesizes voiced signals and then finally adds the unvoiced signal and the voiced signal in the current band.

The conventional method used in the conventional voiced/unvoiced information estimation system will be explained with reference to FIG. 2. First, an input spectrum is obtained by Fourier transformation of a voice input signal in S11. FIG. 3A illustrates a voice spectrum in a time domain. FIG. 3B illustrates a voice spectrum in a frequency (harmonic) domain after Fourier transformation. In addition, a synthetic spectrum is obtained by using a fundamental frequency, harmonic parameters, and a window spectrum.

When an input spectrum and a synthetic spectrum are obtained in S13, a plurality of harmonic bands, i.e., three harmonic bands, are combined and are set as one voicing level decision band. That is, the first three harmonic bands of a plurality of harmonic bands are combined and set as the first (k=1) voiced degree decision band, and the second three harmonic bands are bonded and set as the second (k=2) voicing level decision band. In this way, harmonic bands are set as the first voicing level decision band through the last (k=K) voicing level decision band. Here, the three harmonic bands are set as one voicing level decision band to decrease the encoding bit rate, and the maximum number of voicing level decision band is usually limited to 12.

When each voicing level decision band is set in S15, the spectrum difference calculation unit 10 performs a normalization process for obtaining a difference between the input spectrum and the synthetic spectrum in the first (k=1) voicing level decision band. The difference is then divided by the input spectrum energy in the current voicing level decision band to obtain the first normalized spectrum difference energy Ek.

When the first normalized spectrum difference energy Ek is obtained in S17, the threshold calculation unit 20 calculates a threshold $\xi k$ for deciding the voicing level in the first voicing level decision band by using the voiced/unvoiced information in the previous frame.

When the calculation of the threshold $\xi k$ is completed in S19, the voiced/unvoiced binary decision unit 30 compares the normalized spectrum difference energy Ek in the first voicing level decision band with the threshold ξk.

If the normalized spectrum difference energy Ek in the first voicing level decision band is lower than the threshold ξk, the voiced/unvoiced binary decision unit 30 determines the value Vk of the voicing level in the current voicing level decision band to be 1 and the current voicing level decision band to be a voiced band in S21. On the contrary, if the normalized spectrum difference energy Ek in the current voicing level decision band is higher than the threshold ξk, the voiced/unvoiced binary decision unit 30 determines the value Vk of the voicing level in the current voicing level decision band to be 0 and the current voicing level decision band to be an unvoiced band in S24.

In S25, it is judged whether or not the current voicing level decision band, i.e, the first (k=1) voicing level decision band, is the last (k=K) voicing level decision band of a predetermined total number K of voicing level decision bands (for example, 12 voicing level decision bands).

Since the first (k=1) voicing level decision band is not the last (k=K) voicing level decision band, the value Vk of a voicing level in the second voicing level decision band is decided by performing the above-described process for the second (k=2) voicing level decision band in S27.

Accordingly, the last (k=K) voicing level decision band, i.e., the $12^{th}$ voicing level decision band, is decided to be a voiced band or a unvoiced band by sequentially performing the process of obtaining the value of a voicing level Vk for each voicing level decision band. When this occurs, the voiced information estimation process is finished without proceeding to the next step.

It is often the case where a voiced element and an unvoiced element are mixed in a certain voicing level decision band when observing a voice spectrum. However, according to the conventional voice information estimation method, one voiced/unvoiced information is decided to be a binary value (either 0 or 1) with respect to three harmonic bands. As a result, a spectrum in the harmonic band is represented as a voiced sound or an unvoiced sound. Thus, if voiced/unvoiced elements are mixed in the same voicing level decision band, it is difficult to accurately represent a spectrum as a voiced sound or unvoiced sound. In addition, the reproduced audio quality sounds unnatural.

The reason for setting three harmonic bands as one voicing level decision band is to decrease the number of quantization bits, which lowers the frequency resolution for voiced/unvoiced information.

In addition, since the voiced/unvoiced information is binary, it is very likely to drastically reduce the audio quality for the threshold. That is, because there is no value representing an intermediate level, the voiced/unvoiced information can be represented as the opposite value completely different from the original value if the threshold is wrongly calculated. Because the number of voiced/unvoiced information having a binary value becomes the quantity of quantization bits, it is necessary to expand the voicing level decision band in order to reduce the quantity of bits. This increasingly lowers the resolution for the frequency of the voiced/unvoiced information, and the voiced/unvoiced information decision process needs to be modified.

SUMMARY OF THE INVENTION

Accordingly, the present invention is directed to a voiced/unvoiced information estimation system and method therefor that substantially obviate one or more of the problems due to limitations and disadvantages of the related art.

It is, therefore, an object of the present invention to provide a system and method of estimating the voiced/unvoiced information of a vocoder in order to prevent audio quality deterioration by reducing the voicing level decision error according to a voiced/unvoiced decision threshold.

It is another object of the present invention to provide a method of estimating the voiced/unvoiced information of a vocoder which is advantageous to vector quantization even at a low bit rate, without deteriorating frequency resolution.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve the above object, there is provided a method of estimating voiced/unvoiced information of a vocoder according to the present invention, including the steps in which: a spectrum difference calculation unit obtains the spectrum difference energy between an input spectrum and a synthetic spectrum of the corresponding harmonic band in units of a predetermined number of harmonic bands, and normalizes the spectrum difference energy; and a voicing level calculation unit calculates a voicing level of the corresponding harmonic band using the normalized spectrum difference energy.

Preferably, the voicing level is calculated in the manner that the normalized spectrum difference energy is subtracted from 1, and is set to a value between 0 and 1.

It is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

Figure 1:
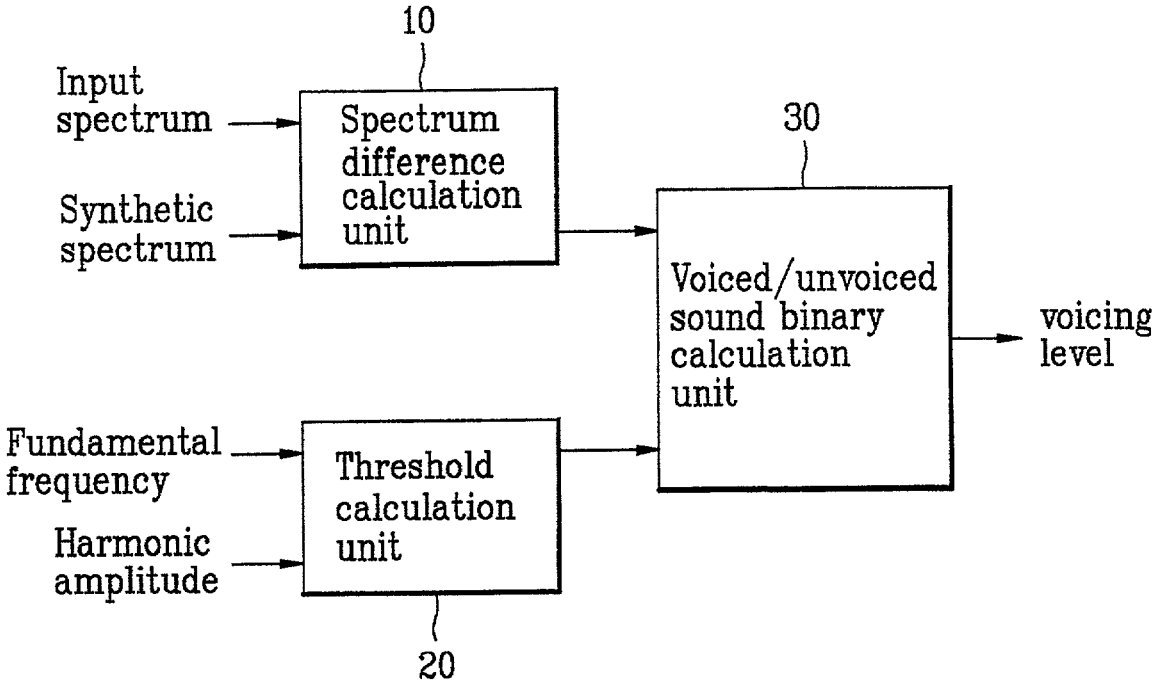
FIG. 1 Related Art
FIG. 1 is a block diagram schematically illustrating a voiced/unvoiced information estimation apparatus of a vocoder according to the conventional art.
Figure 2:
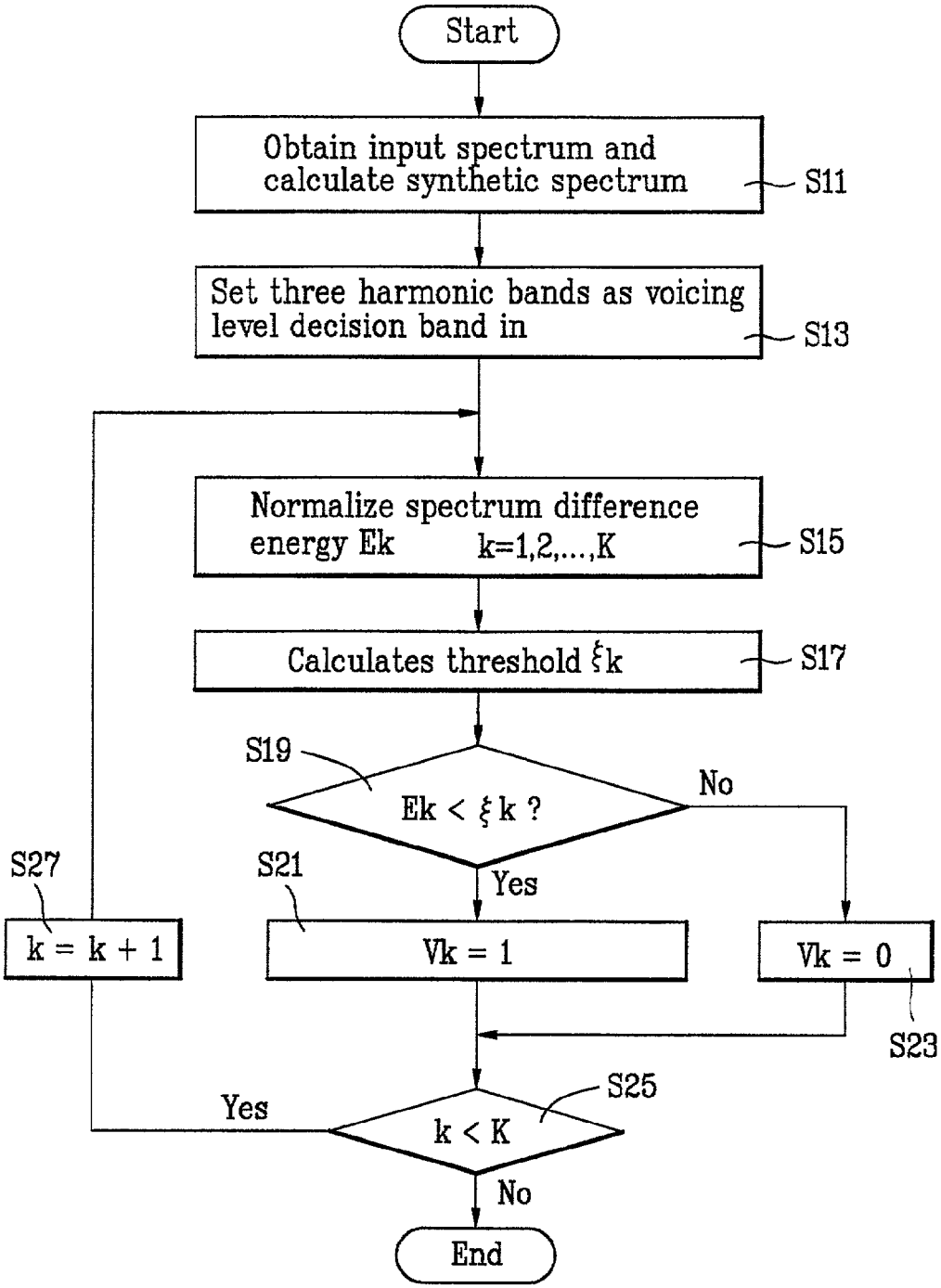
FIG. 2 Related Art
FIG. 2 is a flow chart illustrating a method of estimating a voiced/unvoiced information of a vocoder according to the conventional art.
Figure 3A:
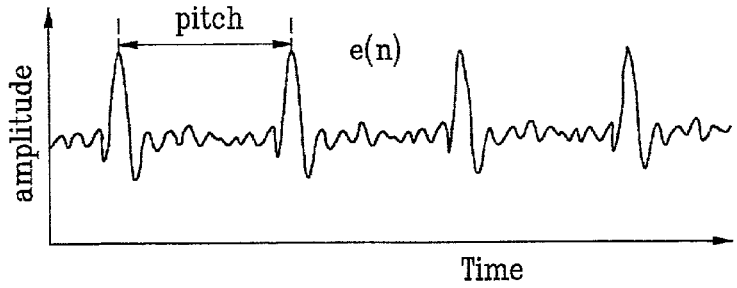
FIG. 3A illustrates a waveform of a voiced signal in a time domain.
Figure 3B:
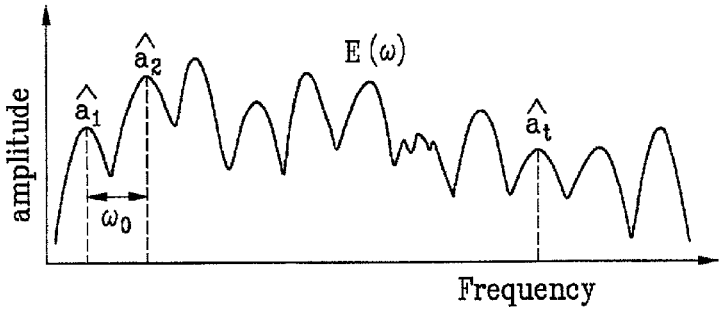
FIG. 3B illustrates a spectrum of the voiced signal in a frequency (harmonic) domain after Fourier transformation.

A preferred embodiment of the present invention will now be described with reference to the accompanying drawings. In the following description, the same drawing reference numerals are used for the same elements, even in different drawings.

Figure 4:
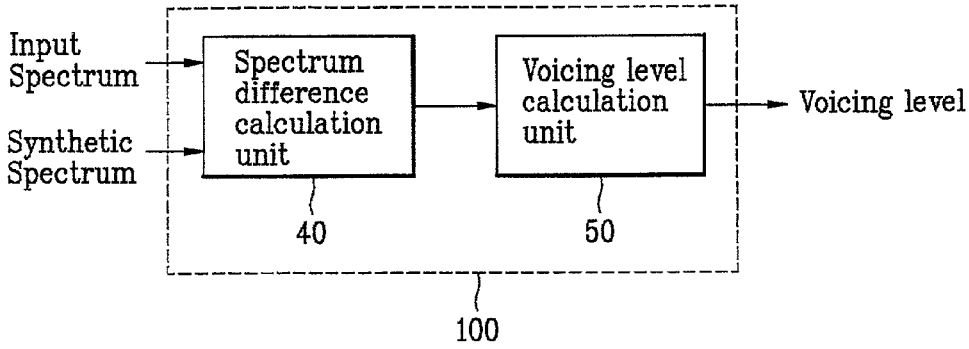
FIG. 4 is a block diagram schematically illustrating a voiced/unvoiced information estimation system used in a vocoder according to a preferred embodiment of the present invention.

Referring to FIG. 4, an estimation system 100 adapted to a voiced/unvoiced information estimation method of a vocoder according to a preferred embodiment of the present invention includes a spectrum difference calculation unit 40 and a voicing level calculation unit 50. The spectrum calculation unit 40 obtains the spectrum difference energy between an input spectrum and a synthetic spectrum, and then divides it by the spectrum energy in the current harmonic band to thereby normalize the same.

The voicing level calculation unit 50 of the estimation system 100 obtains a voicing level having a value between 0 and 1 using the normalized spectrum difference energy. An encoder quantizes the obtained voiced/unvoiced information, and a decoding end synthesizes a voiced element and an unvoiced element in each harmonic band and mixes the two elements at the rate of voicing. The voicing level calculation unit 50 performs the process shown in FIG. 5.

Therefore, the voicing level calculation unit 50 is preferably made with a Programmable Logic Device, Application Specific Integrated Circuit (ASIC) or other suitable logic devices known to one of ordinary skill in the art.

In the estimation system 100 according to the preferred embodiment, since a voicing level having a value between 0 and 1 is obtained, a threshold calculation unit for deciding a voiced/unvoiced information is unnecessary and the voiced/unvoiced decision anomaly caused by thresholding is eliminated. Furthermore, since a spectrum is represented in a harmonic band as a mixture of a voiced spectrum and an unvoiced spectrum a natural audio quality can be obtained.

Figure 5:
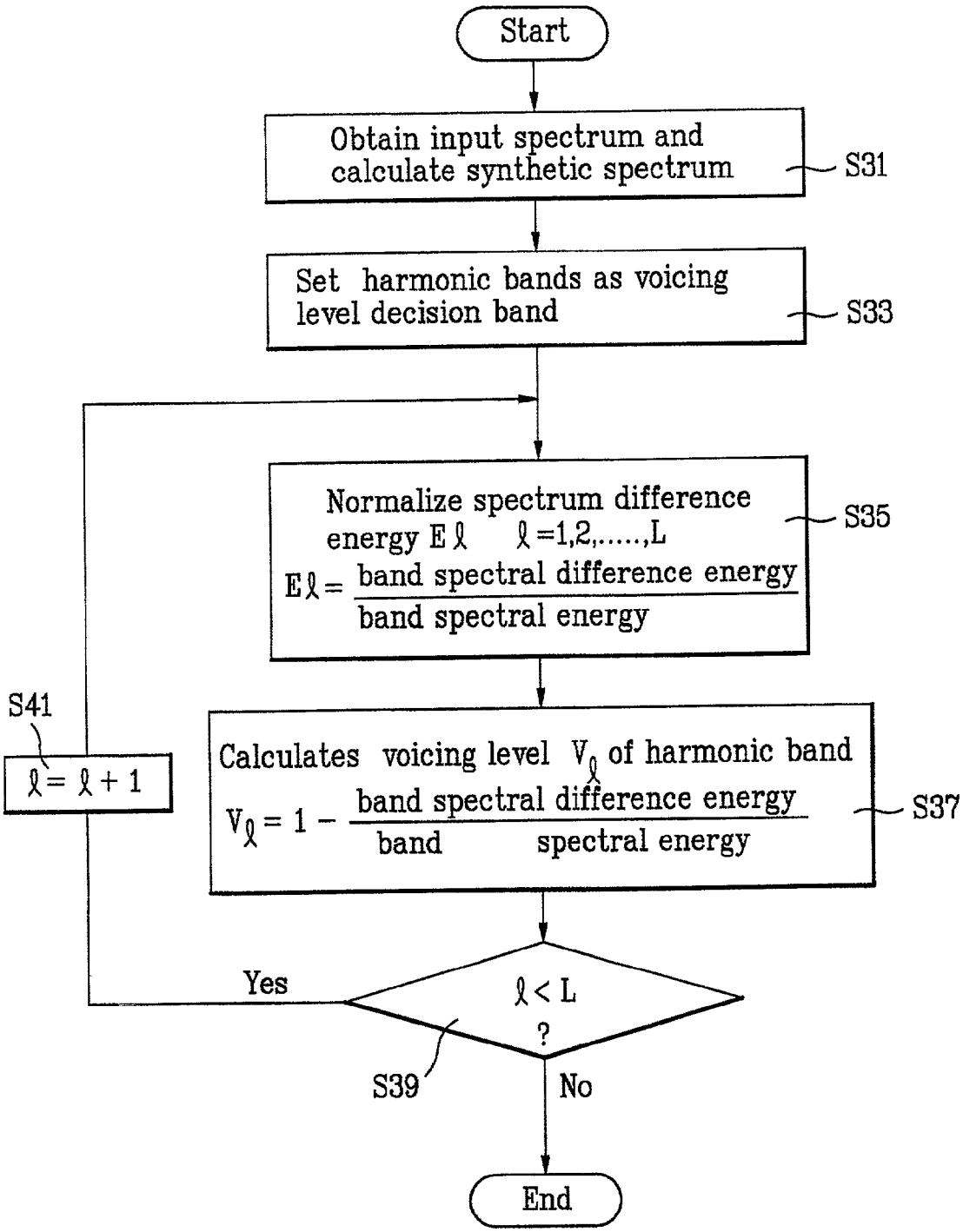
FIG. 5 is a flow chart illustrating estimation of voiced/unvoiced information according to the preferred embodiment of the present invention.

FIG. 5 is a flow chart illustrating estimation of voiced/unvoiced information according to the preferred embodiment of the present invention. First, an input spectrum is obtained by Fourier transformation of a voice input signal in S31. Preferably, a fast Fourier transformation (FFT) algorithm or other suitable signal processing known to one of ordinary skill in the art is used. Then, a synthetic spectrum is calculated by using a fundamental frequency, harmonic parameters, and a window spectrum.

When an input spectrum and a synthetic spectrum are obtained, each harmonic band is set as a voicing level decision band in S33. The first harmonic band is set as the first (l=1) voicing degree decision band, and the second harmonic band is set as the second (l=2) voicing level decision band. This way, each of the first (l=1) harmonic band through the last (l=1) harmonic band is set as a voicing level decision band. Here, the total number (L) of the harmonic bands is between 10 and 60, provided that pitch ranges 20 to 120 at 8 KHZ sampling.

When each voicing level decision band is set, the spectrum difference calculation unit 40 obtains a difference energy between an input spectrum and a synthetic spectrum in the first (l=1) harmonic band in S35. The spectrum difference calculation unit 40 then divides the difference energy by an input spectrum energy in the current harmonic band to normalize the same, obtaining the first normalized spectrum difference energy $E_l$.

When the first normalized spectrum difference energy $E_l$ is obtained, the conventional process for calculating a threshold $\xi k$, for deciding a voicing level in each harmonic band by using a spectrum energy distribution, a fundamental frequency, and a voiced/unvoiced information in the previous frame is omitted. In addition, the spectrum difference calculation unit 40 calculates a voicing level $V_l$ having a value between 0 and 1 using the first normalized spectrum difference energy $E_l$ in S37. That is, the voicing level $V_l$ of the first harmonic band is obtained by subtracting the first normalized spectrum difference energy $E_l$ from 1.

Therefore, in the present invention, since a voicing level having a value between 0 and 1 is obtained, a threshold calculation unit for deciding a voiced/unvoiced sound is unnecessary, thereby resulting in the simplification of the vocoder and eliminating a decision anomaly caused by thresholding. Additionally, since a spectrum is represented as a mixture of a voiced element and an unvoiced element in a harmonic band, the natural audio quality of a combined sound can be improved. Furthermore, in the present invention, since a voicing level is obtained in units of harmonic band, the frequency resolution is higher compared to the conventional method for binding three harmonic bands. Therefore, the method of the invention is appropriate for a harmonic vocoder to perform encoding and synthesizing in units of harmonic band.

When the voicing level $V_l$ of the first harmonic band is calculated in S37, it is determined whether the current harmonic band, i.e., the first (l=1) harmonic band, is the last (l=1) harmonic band among the harmonic bands of the total number(L) (for example, 36 harmonic bands).

Since the current harmonic band is not the last (l=1) harmonic band, a voicing level $V_l$ is obtained by performing the same process as the first harmonic band with respect to the second (l=1) harmonic band. In this way, the voiced information of the last (l=1) harmonic band is calculated by sequentially performing the process for obtaining a voicing level $V_l$ for each harmonic band, and the voiced information estimation process is finished without proceeding to the next step.

Therefore, in the conventional system, vector quantization cannot be performed because a voiced/unvoiced information has a binary value of 0 or 1, although it is well known that vector quantization is effective in reducing a bit rate. In the estimation system 100 according to the preferred embodiment of the present invention, a voicing level $V_l$ has a continuous value between 0 and 1, and therefore, can be effectively quantized using a codebook which consists of code vectors at a low bit rate. If the number of encoding bits allocated is large, the number of code vector for quantization is increased. If the number of encoding bits allocated is small, the number of code vectors for quantization is decreased.

EVRC (enhanced variable rate codec) and AMR(Adaptive Multi Rate coder), which are vocoders recently being used in mobile communication systems, adapt a variable bit rate for the effective management of channels. In the present invention and unlike the conventional system, it is possible to realize a variable bit rate encoder by controlling the number of quantization bits without changing the algorithm of the voice/unvoiced information estimation unit.

As described above, in the voiced/unvoiced information estimation method of the vocoder according to the present invention, an input spectrum and a synthetic spectrum are obtained, the spectrum difference calculation unit normalizes a spectrum difference energy for each harmonic band in unit of harmonic band, and the voicing level calculation unit calculates a voicing level.

Figure 6A:
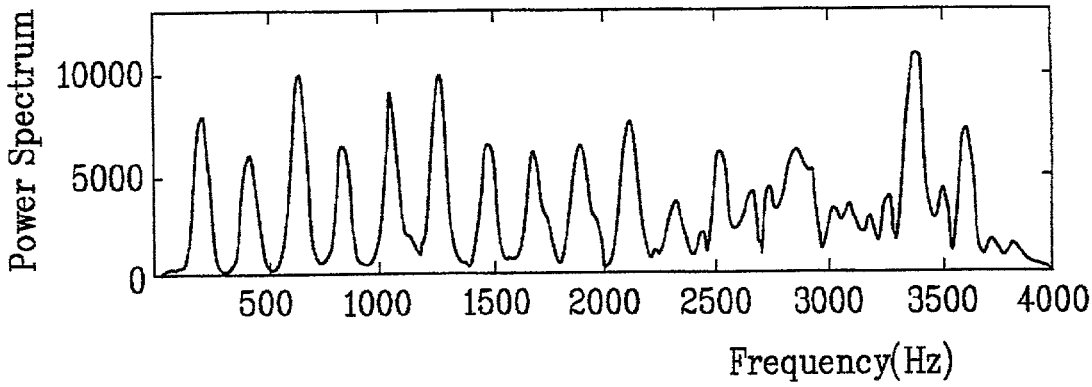
FIG. 6A illustrates a sample speech spectrum in a frequency domain used as an input to the estimation system of the present invention.
Figure 6B:
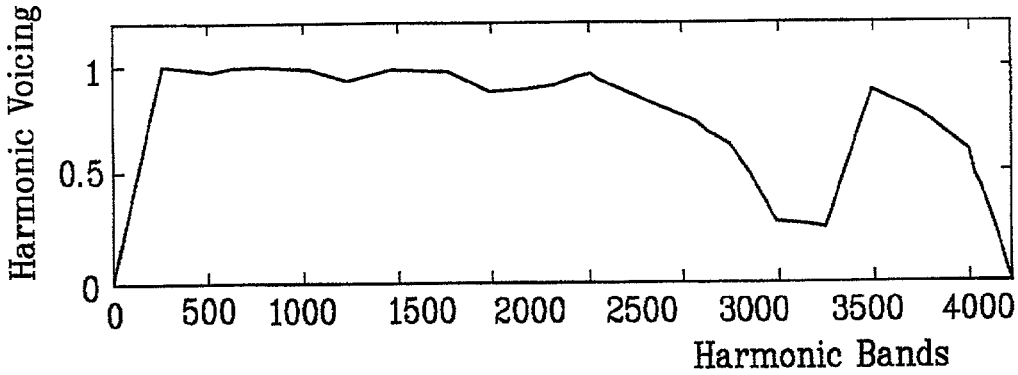
FIG. 6B illustrates a voicing level output of the estimation system according to the preferred embodiment of the present invention.
Figure 6C:
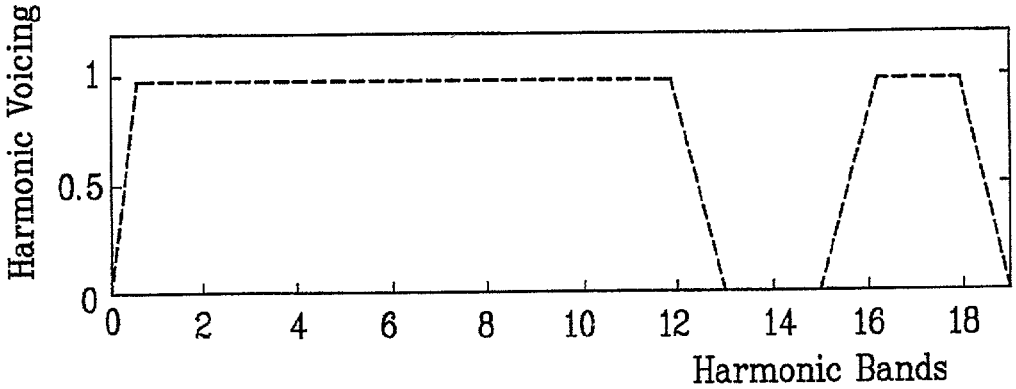
FIG. 6C illustrates a binary voicing level output of the conventional estimation system.

FIG. 6A illustrates a speech spectrum in a frequency domain used as an input to the estimation system 100 of the present invention. When such spectrum is introduced to the conventional estimation system in FIG. 1, the voicing level output is shown in FIG. 6C which has a binary output due to the thresholding effect described above. However, when such spectrum is introduced to the estimation system 100 of the present invention (shown in FIG. 4 and subjected to the processing of FIG. 5), the voicing level output is shown in FIG. 6B. As shown in FIG. 6B, the voicing level has values between 0 and 1 which cannot be obtained through the conventional estimation system.

According to the present invention, since a voicing level of each harmonic band has a continuous value between 1 and 0, this invention is effective in vector quantizaion of a voiced/unvoiced information at a low bit rate. Since it is unnecessary to calculate a threshold for deciding a voiced/unvoiced information, the decision difference occurring according to a threshold is eliminated, and the accuracy of a voicing level can be improved. Furthermore, since a spectrum is represented as a mixture a voiced element and an unvoiced element in a harmonic band, it is possible to improve the audio quality of a combined sound. In addition, it is possible to realize a variable bit rate encoder by controlling the number of quantization bits without changing the algorithm of the voice/unvoiced information estimation unit.

It is understood that other embodiments may be utilized and structural and operational changes may be made without departing from the scope of the present invention. For example, although the preferred embodiments are described in the context of an estimation system used in a vocoder, the present application can apply to any digital signal processing devices.

The foregoing embodiments and advantages are merely exemplary and are not to be construed as limiting the present invention. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. A method of estimating voiced/unvoiced information from a voice input signal, the method comprising:

transforming the voice input signal into an input spectrum having input spectrum energy;

calculating a synthetic spectrum having synthetic spectrum energy using at least one of a fundamental frequency, a harmonic size and a window spectrum;

determining at least one voice level decision band from the input spectrum and the synthetic spectrum;

determining a band spectral difference energy for the at least one voice level decision band by finding the difference between the input spectrum energy and the synthetic spectrum energy;

normalizing the band spectral difference energy with the input spectrum energy to determine a normalized spectra difference energy; and calculating a voicing level corresponding to the at least one voice level decision band using the normalized spectra difference energy, the voicing level calculated without utilizing a threshold such that a mixture of a voiced element and an unvoiced element are represented.

2. The method of claim 1, wherein the voicing level is calculated by subtracting the normalized spectra difference energy from 1.

3. The method of claim 1, wherein the voicing level is determined to be a value between 0 and 1.

4. The method of claim 1, further comprising determining a plurality of voice level decision bands from the input spectrum and the synthetic spectrum, wherein the voicing level is determined for each of the plurality of voice level decision bands.

5. The method of claim 4, wherein there are L voice level decision bands, L having a value between 10 and 60.

6. The method of claim 1, wherein the voice input signal is transformed into the input spectrum having input spectrum energy using Fourier transformation.

7. A method of estimating voiced/unvoiced information from a voice input signal, the method comprising:

transforming the voice input signal into an input spectrum having input spectrum energy;

obtaining a synthetic spectrum having synthetic spectrum energy using at least one of a fundamental frequency, a harmonic size and a window spectrum;

determining L voice level decision bands from the input spectrum and the synthetic spectrum, wherein L is an integer;

determining a corresponding band spectral difference energy for each voice level decision band by finding the difference between the respective input spectrum energy and the respective synthetic spectrum energy;

normalizing the band spectral difference energy with the input spectrum energy to determine a normalized spectra difference energy for each voice level decision band; and calculating a voicing level corresponding to the each voice level decision band using the normalized spectra difference energy, the voicing level calculated without utilizing a threshold such that a mixture of a voiced element and an unvoiced element are represented.

8. The method of claim 7, wherein the voicing level is calculated by subtracting the normalized spectra difference energy from 1.

9. The method of claim 7, wherein the voicing level is determined to be a value between 0 and 1.

10. The method of claim 7, wherein L has a value between 10 and 60.

11. An estimation system for estimating voiced/unvoiced information from a voice input signal, the estimation system comprising:

means for transforming the voice input signal into an input spectrum having input spectrum energy;

means for obtaining a synthetic spectrum having synthetic spectrum energy using at least one of a fundamental frequency, a harmonic size and a window spectrum;

means for determining at least one voice level decision band from the input spectrum and the synthetic spectrum;

means for determining a band spectral difference energy for the at least one voice level decision band by finding the difference between the input spectrum energy and the synthetic spectrum energy;

means for normalizing the band spectral difference energy with the input spectrum energy to determine a normalized spectra difference energy; and means for calculating a voicing level corresponding to the at least one voice level decision band using the normalized spectra difference energy, the voicing level calculated without utilizing a threshold such that a mixture of a voiced element and an unvoiced element are represented.

12. The estimation system of claim 11, wherein the means for calculating the voicing level subtracts the normalized spectra difference energy from 1 to find the voicing level.

13. The estimation system of claim 11, wherein the voicing level is determined to be a value between 0 and 1.

14. The estimation system of claim 11, further comprising a plurality of voice level decision bands determined from the input spectrum and the synthetic spectrum, wherein the voicing level is determined for each of the plurality of voice level decision bands.

15. The estimation system of claim 14, wherein there are L voice level decision bands, L having a value between 10 and 60.

16. The estimation system of claim 11, wherein the voice input signal is transformed into the input spectrum having input spectrum energy using Fourier transformation.

17. An estimation system for estimating voiced/unvoiced information from a voice input signal, the estimation system comprising:

means for transforming the voice input signal into an input spectrum having input spectrum energy;

means for obtaining a synthetic spectrum having synthetic spectrum energy using at least one of a fundamental frequency, a harmonic size and a window spectrum;

a spectrum difference calculation unit to determine at least one voice level decision band from the input spectrum and the synthetic spectrum and to determine a band spectral difference energy for the at least one voice level decision band by finding difference between the input spectrum energy and the synthetic spectrum energy and normalizing the band spectral difference energy with the input spectrum energy to determine a normalized spectra difference energy; and a voicing level calculation unit to calculate a voicing level corresponding to the at least one voice level decision band using the normalized spectra difference energy, the voicing level calculated without utilizing a threshold such that a mixture of a voiced element and an unvoiced element are represented.

18. The estimation system of claim 17, wherein the voicing level calculation unit subtracts the normalized spectra difference energy from 1 to find the voicing level.

19. The estimation system of claim 17, wherein the voicing level is determined to be a value between 0 and 1.

20. The estimation system of claim 17, wherein a plurality of voice level decision bands is determined from the input spectrum and the synthetic spectrum and the voicing level is determined for each of the plurality of voice level decision bands.

* * * * *